US005854584A

United States Patent [19]

Rögelein

[11] Patent Number: 5,854,584

[45] Date of Patent: Dec. 29, 1998

[54] PROTECTIVE DEVICE AGAINST THERMAL OVERLOAD FOR A SMALL HIGH-HEAT-LOAD ELECTRIC MOTOR

[76] Inventor: Dieter Rögelein, Kernerstrasse 35, D-70182 Stuttgart, Germany

[21] Appl. No.: 704,501

[22] PCT Filed: Apr. 5, 1995

[86] PCT No.: PCT/DE95/00464

§ 371 Date: Oct. 7, 1996

§ 102(e) Date: Oct. 7, 1996

[87] PCT Pub. No.: WO95/27302

PCT Pub. Date: Oct. 12, 1995

[30] Foreign Application Priority Data

Apr. 5, 1994 [DE] Germany ..... 44 11 712.4

[51] Int. Cl.[6] ..... H01H 37/52

[52] U.S. Cl. ..... 337/333; 337/102; 337/380

[58] Field of Search ..... 337/111, 113, 337/333, 343, 362, 365, 379, 380, 102, 377; 361/103, 105

[56] References Cited

U.S. PATENT DOCUMENTS 4,532,488 7/1985 Blackburn ..... 337/111

*Primary Examiner*—Leo P. Picard
*Assistant Examiner*—Jayprakash N. Gandhi
*Attorney, Agent, or Firm*—Max Fogiel

[57] ABSTRACT

A device for protecting a fractional-horsepower motor from overheating. The motor is intended to accommodate a high heat load. Its power supply accommodates a make-or-break switch. A bimetal component opens the switch once a certain temperature has been attained. The bimetal component is mounted on a support. The switch, the bimetal component, and its support are electrically connected in series. There is a specific ratio between the electrical impedance and heat capacity of the bimetal component and those of its support, and they are extensively in surface-to-surface contact.

9 Claims, 2 Drawing Sheets

PROTECTIVE DEVICE AGAINST THERMAL OVERLOAD FOR A SMALL HIGH-HEAT-LOAD ELECTRIC MOTOR

BACKGROUND OF THE INVENTION

The present invention concerns a device for protecting a fractional-horsepower motor from overheating. The motor is intended to accommodate a high heat load. The motor has a stator of permanently magnetic material and a rotor with an electric winding. The motor is employed for rapidly turning automotive accessories on and off. Its power supply accommodates a make-or-break switch. A bimetal component opens the switch, preferably suddenly and as suddenly as a snap-in disk for example, once a certain temperature has been attained. The bimetal component is mounted on a support that has one or more parts. The switch, the bimetal component, and its support are electrically connected serially. There is a specific ratio between the electric impedance and heat capacity of bimetal component and those of its support, and they are extensively in surface-to-surface contact.

Many small motors of this type are employed for various accessory functions in motor vehicles—for automatically raising and lowering windows, adjusting seats, sliding roofs, or folding tops and for operating pneumatic and hydraulic pumps and antenna-drive mechanisms, for example. The motors are direct-current, permanent-magnet components and have power ratings of 12 or 24 volts. They are usually connected downstream to a transmission with a high ratio. Although they generally operate only briefly, the motors must accomplish a lot during those brief periods. They can easily overload during normal operation when the component being driven is obstructed in its assigned path or when the controls are applied improperly or excessively. The motor, especially its rotor winding and brushes or brush holders, can overheat.

The fractional-horsepower motors employed for such and similar purposes must also be small and light in weight. The requisite outputs can accordingly only be achieved at loads ranging mainly from a maximum level to short-circuit or breakdown levels. This is particularly true of what are called brief-operation motors. Other factors critical to the operation of such motors in vehicles are the wide fluctuations in temperature and battery voltage. The temperatures can range from −40° to +80° C., and the potentials from 9 to 15 or 18 to 30 V. Also significant in the event of obstruction is the extent to which the motor's carbon brushes cover the commutator segments. In a typical window opening-and-closing motor with a 10-groove armature, a coverage of 2 segments will yield a total impedance of 0.479 Ω, and a coverage of 4 segments a total impedance of 0.385 Ω. The initial obstruction currents will, even at a constant power of 13 V and an ambient temperature of +25° C. for instance, be 27.1 A for 2 segments and 33.7 A for 4 segments. To some extent bridged windings at a coverage of 4 segments will lead, due to the low armature impedance and to the low mass of the circuit, to higher temperature-variation rates and accordingly shorter time constants.

The obstruction currents that will then occur over an operating-temperature range of −40° to +80° C., at a power of 13 V, at the different commutator coverages, and at impedance variations over the copper-winding temperature gradients are 36.7 to 45.6 A at an ambient temperature of −40° C. and 22.7 to 28.5 A at an ambient temperature of +80° C.

SUMMARY OF THE INVENTION

The device in accordance with the present invention will accordingly need to satisfy the demands that will now be described in order to cope with obstruction subject to the aforesaid conditions.

At an ambient temperature of +25° C. and at an initial obstruction current of 27.1 to 33.7 A at 13 V, the device will have to switch the motor off in more than 4 and less than 10 seconds.

It will need to discontinue an initial obstruction current of 18.3 to 23.4 A at 9 V in less than 30 seconds, within, that is, the motor's time constant in terms of the particular operating situation, before the permissible threshold temperatures of the winding or brushes are attained.

At an ambient temperature of −40° C., an initial obstruction current of 42.3 to 52.6 A at 15 V will need to be discontinued in less than 12 seconds.

An initial obstruction current of 25.4 to 31.6 A at 9 V must be discontinued in less than 45 seconds.

At an ambient temperature of +80° C. an initial obstruction current of 26.4 to 32.4 A at 15 V must be discontinued in more than 2 seconds in order to ensure long enough operation when the window mechanism is difficult to access.

The motor-protecting device must accordingly have control throughout its ambient-temperature and operating-voltage range over switching currents in the form of currents of 15.7 to 52.6 A in the event of obstruction along with long enough operating times in heavy-load applications adjacent to the moment of short circuit.

The aforesaid situations imply that a motor of this type not protected against overheating can be operated for approximately only 20 to 30 seconds near the short-circuit point without damage to the winding or to other components because winding temperatures higher than 300° C. or brush temperatures higher than 200° C. for example will cause destruction. Although short-circuit operation times can be extended with conventional motor protectors, based on the known thermostatic-switch principle, the overall operating-temperature range and overall operating-voltage range can be covered only unsatisfactorily. Compromises must be accepted with respect to the acceptable operating time subject to heavy loads at +80° C. or when rendering an obstruction situation harmless at the minimum ambient temperature of −40° C. and subpotentials of 9 to 11 V. The compromises usually selected are those that allow very short operating times at high loads and high ambient temperatures for higher heat sensitivity and increased current sensitivity in order to ensure short-circuit resistance at −40° C. in the low ambient-temperature range and at subpotential. The motors will in that event usually be overprotected and of limited use in terms of their useful moment at room temperature or higher ambient temperatures.

Known motor protectors, which counteract the overheating that accompanies faulty or mechanically impeded operation, operate in conjunction with temperature-dependent and current-dependent switches, particularly bimetal (and trimetal etc.) components. The paralleled layers of metal have different coefficients of heat expansion, and change shape as they heat up. The change can be utilized to actuate a switch. Such bimetal components and their applications to the field in question are known. They react to any heating up of the ambient (outside) temperature as well as to any internal heating due to current ("I2R" current heat). They also respond to increases in the temperature ambient to their position in the overall system due to the occurrence of heat in the overloaded parts. Such heat acts in the capacity of recirculated heat over the motor's time constant, abbreviating maintenance times and increasing pauses until thermal equilibration is attained. Heat can also enter or be prevented from entering through components that are either attached so as to conduct heat or positioned so as to radiate heat. Such components accordingly function as heat reservoirs.

In one embodiment of a known genus, heat is supplied to the bimetal component by way of a heat-conduction attachment to a brush or to its quiver, which will be metal in the event. The heat will be approximately the same as the heat emitted by the motor's armature winding. It will accordingly supply heat to the bimetal component when the motor is subjected to considerable heat, in the event of a short circuit for example, once the generated current heat has dropped in the motor-engagement phase, especially while the contacts are open once the motor has been intentionally engaged. The bimetal component will rapidly return the switch to the "on" position, and the resupply of current to the motor will be delayed. This sort of device is described in German Patent 2 811 503 for example.

Other embodiments divert heat from a heat reservoir to the bimetal component not only from the aspect of heat conduction but also from that of radiation all the way to heat flow. One known motor protector for instance, described in European Patent 0 226 663 A1, employs spacers made of a material with a positive temperature coefficient. The spacers are intended to act on a bimetal component as hereintofore described. They extend, however, more perpendicular to its surface, and the effect of heat radiation can be considered slight. European Patent 0 104 809 B1 for another example describes a spiraling heating component that more or less parallels a bimetal component. It must also, since the effect of the distance between the heating component and the bimetal component is mentioned, heat the bimetal component primarily by radiation.

GB Patent mentions a connection paralleling a bimetal component and intentionally provided with resistance for the purpose of storing heat. It acts as a heating component for a bimetal component. The heat is applied over a long section that overlaps at least some of the bimetal component and is in intimate contact with it. The impression is one of heat transfer more by conduction and less by radiation.

The reader is referred with respect to bimetal components of the type discussed herein to the description of the state of the art and relevant fields in German OS 3 401 968.

As the switching current increases in state-of-the-art motor protectors of the type in question, the switching-off duration (pause time) subsequent to the first switching off (overheating-dictated termination of the switching-on or maintenance time initiated by a normal switching-on procedure) in the following switching cycle tends to become shorter in the event of lasting overload. Only be lasting obstruction is there a slight elevation in the pause times. Initially, accordingly, the increasing heat of the winding increases the switching-on duration. The switching-on or maintenance times increase, and the pause times remain approximately constant during the following switching cycles and increase slightly when a recovery is obtained in the control circuit due to an increase in the temperature immediately surrounding the motor protector. The ratio of switching-on duration to switching-off duration increases, and the heat in the winding or brush increases. A long-lasting disruption, especially in extreme situations, when the lowest ambient temperature is −40° C. and the lowest operating voltage is 9 V for example, can accordingly lead to the threat of detrimental overheating. It needs only to be said for the purpose of illustration that low-noise and low-cost carbon-brush holders of plastic, usually polyamide, have a heat-storage capacity of approximately 20° C.

Although motor-protection devices with higher current sensitivities can decrease the risk of overheating, they result in shorter motor life at the highest operating temperatures of +80° C. accompanied by brief overload.

The object of the present invention is accordingly to improve the protection attainable with a device of the aforesaid genus by limiting increases in the temperatures of the brushes and windings even when the motor is subjected to a long-lasting malfunction-dictated overload situation while simultaneously extending the life of the motor over the total operating-temperature range and operating-voltage range for the exploitable short-term overload situation.

With a motor-protection device of the aforesaid genus as a point of departure, this object is attained in accordance with the present invention in that the support is flat and radiates heat toward the bimetal component and by the dimensioning of the ratios between the electric impedances and the heat-storage capacities of bimetal component and those of its support such that switching cycles following the maintenance time, which is determined by when the motor is first turned on properly and when it is first turned off due to overheating, provide an increasingly shorter switching-on duration as the overload continues at constant current. When the motor is obstructed, the switching-on durations will remain almost constant in spite of the decreasing obstruction current until recovery takes effect due to an increase in the ambient temperature in the immediate vicinity of the device and thermal equilibrium is attained at a brief switching-on duration.

The impedance-providing materials in the present case are within a specific heat-capacity range of 0.095 to 0.114 kcal/kg grd for specific densities of 8.600 to 7.900 kp/m3, so that the masses are at least comparable in relation to their heat-storage capacity. The heat-capacity ratios and the selection of the ratio of the electric impedance and mass of the support acting as a heat reservoir to the electric impedance and mass of the bimetal component are decisive for ensuring that the switching-on durations in the switching cycles following the first maintenance time (first switching-on interval) will decrease constantly until thermal equilibrium has been achieved while the ratio of switching-on duration to switching-off duration increases. This behavior leads in particular to the achievement of a state of equilibrium with no overshooting on the part of the brush temperatures or winding temperatures, and specifically preferably such that, subsequent to the first maintenance time, which is as long as possible, the following pause time will be less than precisely 15 seconds and the second maintenance time will be at least 0.7 seconds. Limiting the switching-off duration within this range is recommended because either the motor's operator or the accessory being driven by it will otherwise tend to assume a real defect.

The switching-temperature difference (ΔK) between an effectively attained final temperature on the part of tie bimetal switching component and the stationary switching-component switchback temperature increases as intended as the current load increases due to the superimposed thermal-recovery hysteresis. Either the specifically dimensioned heat reservoir or the aforesaid ratios of the heat-storage capacity and electric impedance of the support acting as a heat reservoir to those of the bimetal component allows one and the same motor-protecting device to cover an extensive bandwidth of different sensitivities. The attainable current-time triggering characteristics are very steep and yield long initial maintenance times accompanied by powerful current and high ambient temperatures along with extreme current sensitivities in the maintenance-time range of 30 seconds.

This is a vary important factor for short-time motors with high temperature-variation rates and hence low time constants (at an ambient temperature of −40° C. and a lower threshold potential of 9 V).

A motor-protecting device in accordance with the present invention is particularly outstanding in that the support in the form of a flat heat radiator is essentially plane parallel to and overlaps to some extent at least one of the two surfaces of the bimetal component while remaining slightly off it, in that the ratio of the heat-storage capacities (masses) of the support to those of the bimetal component are at least 1.5:1 to 3.5:1, and in that the ratio of the electric impedance of the support to that of the bimetal component is at least 4:1 to 8:1.

The bimetal-component support in one preferred embodiment or procedure is adapted to the aforesaid ratios, specifically by the intentional design of specific areas of definite zones for the purpose of determining electric impedance and heat-conduction capacity. One zone can in particular for this purpose be created by one or more cutouts in the bimetal-component support.

The bimetal-component support can comprise one or more parts and extend adjacent to only one of the surfaces of the bimetal component. It can on the other hand accommodate the bimetal component between matching partial sections on each side of the surfaces between itself.

The bimetal component in one practical embodiment is a flat snap-in disk component with an inward-projecting root for securing to a fastening end bent out of the plane of the support and with a tongue projecting out from the stationary switch contact, which is mounted on a connection prong. The switch contact that moves subject to the heat-induced snapping motion of the bimetal component rests on the tongue. The support has a web that extends over the root and the adjacent areas of the bimetal component. At the ends of the support are parallel bracing legs. One leg is shorter and opens into an adjacent bent-out fastening end, which projects toward the other end of the leg. The other leg is longer and merges into a connection prong. The motor-protecting device can have a housing enclosing the bimetal component and its support. The housing can be terminated by a base that accommodates the individual components and connections.

BRIEF DESCRIPTION OF THE DRAWINGS

One embodiment of the present invention will now be specified with reference to the accompanying drawing, wherein.

DESCRIPTION OF THE PREFERRED EMBODIMENTS

Figure 1:
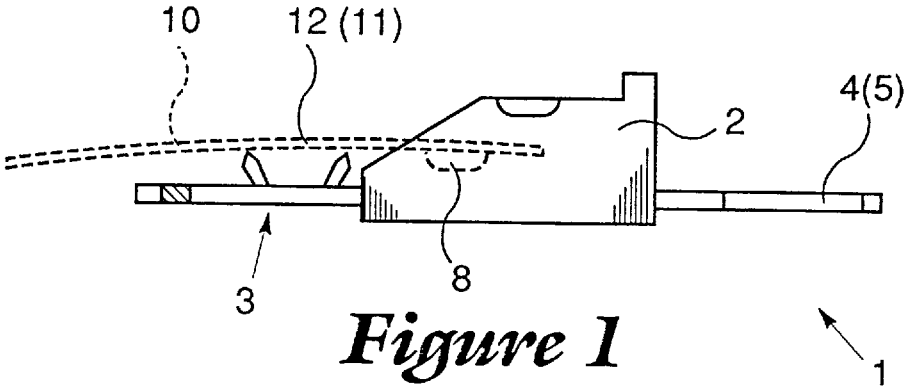
FIG. 1 is a schematic side view, FIG. 2 a schematic view from the side facing away from the connecting tabs.
Figure 2:
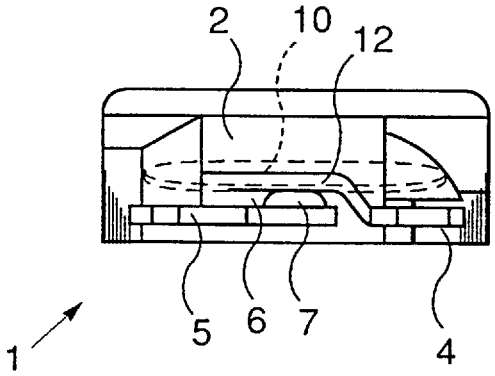
Figure 3:
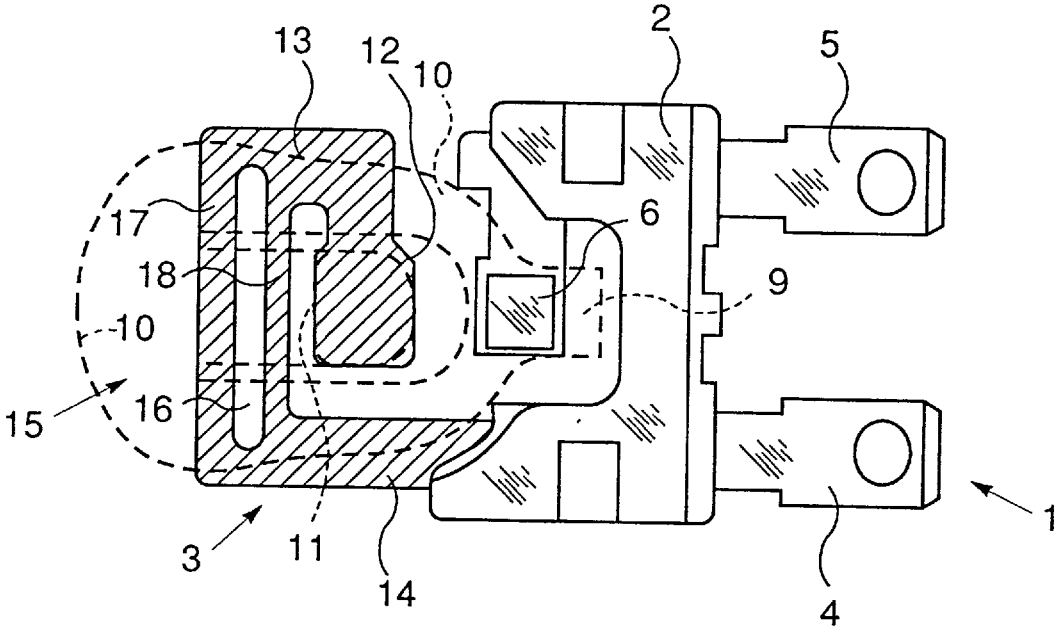
FIG. 3 is a top view more or less perpendicular to the surface of the bimetal component and its support.

A motor-protecting device 1 has a base 2 whereon all the device's components are mounted. An unillustrated housing can be mounted on base 2 to accommodate all the device's components with the exception of two connection prongs 4 and 5, which extend out of the base.

A flat support 3 extends through base 2 and merges into connection prong 4. Connection prong 5 extends through base 2. Mounted on the end of connection prong 5 that is at an angle to connection prong 4 is the stationary contact 7 of a make-or-break switch 6.

A moving contact 8 is mounted on a tongue 9 that extends back toward stationary contact 7 from a bimetal component 10 in the form of a snap-in disk. Bimetal component 10 has a root area 11 t hat extends into the ring. Root area 11 is secured by spot welding or other permanent means to the fastening end 12 of bimetal-component support 3. Fastening end 12 is to bent up toward the level of the ring.

A web 15 in the area of bimetal-component support 3 facing away from connection prong 4 extends at, a right angle to connection prongs 4 and 5 over the total width of bimetal component 10, partly concealing and securing its surface. Extending at an angle out of each end of web 15 are legs 13 and 14. Leg 13 extends toward connection prong 5, and leg 14 merges straight into connection prong 4. One area of bimetal-component support 3 that is of particular significance in the present context is the area relatively close to bimetal component 10 and partly concealing its surface. This area is hatched in the drawing for emphasis. Bimetal-component support 3 constitutes a heat reservoir, and heat is conveyed from it to bimetal component 10 primarily by radiation.

Bimetal component 10 is considerably superior to its support 3 in mass and impedance. The heat-storage capacity or the mass and impedance of the heat-reservoir support can accordingly be adjusted to those of the bimetal component, specifically at a ratio of 1.5 to 3.5 units of support mass to 1 unit of bimetal mass and at a ratio of 4 to 8 units of support impedance to 1 unit of bimetal impedance. These ratios can be established by cutting out areas of various sizes, the cutout 16 in the web 15 on bimetal-component support 3 for example. The cutout 16 in web 15 creates strap-like zones 17 and 18 that determine both electric impedance and heat conductivity. The heat flowing out of bimetal-component support 3 and into the root area 11 of bimetal component 10 and vice versa by way of bent-up fastening end 12 can accordingly also be regulated.

Make-or-break switch 6, bimetal component 10, and bimetal-component support 3 are connected in series between connection prongs 4 and 5, which are inserted into the circuitry supplying the unillustrated motor winding. The current supplying the motor will accordingly flow through them as well. Bimetal component 10 and bimetal-component support 3 are intentionally provided with impedance and will heat up and store heat at the aforesaid ratios. When the motor is overloaded, bimetal component 10 will deform subject to the heat and will open make-or-break switch 6, interrupting the flow of current through the motor coil and the motor-protecting device. How much heat the bimetal component is subjected to will be influenced by how much heat it is intended to store. Subsequent to considerable overheating accordingly, due to high operating potential and a resultingly more powerful current for example, the first pause time to occur will be extended and the subsequent maintenance times abbreviated. The subsequent pause times will remain more or less constant, however, due to the heating up of the winding in spite of the decreasing current. The switch-on duration will accordingly be shorter with no need to recover motor heat by heating up the armature. As the motor heats up subject to continued overload, the switch-on times will constantly decrease and the pause times increase until thermal equilibrium is attained. Since equilibrium will be attained at an extremely short switch-or duration, typically less than 5%, the resulting winding temperatures and carbon-brush temperatures will be very low. Typical winding temperatures are 150° to 180° C. for instance and typical brush temperatures 135° to 170° C.

I claim:

1. A device for protecting a fractional-horsepower motor from overheating when accommodating a high heat load, comprising: a make-or-break switch; a bimetal component for opening said switch, suddenly once a specific temperature has been attained; a support for mounting said bimetal component and having at least one part; said switch, said bimetal component, and said support being electrically connected in series; said bimetal component having an electrical impedance and a heat capacity that have a specific ratio to the electrical impedance and heat capacity of said support, said bimetal component and said support being in extensive surface-to-surface contact; said support being flat and radiating heat toward said bimetal component; said ratio being dimensioned so that switching cycles following a maintenance time determined by when the motor is first turned on and when said motor is first turned off due to overheating, provide an increasingly shorter switching-on duration as an overload continues at constant current and have an increasing ratio of switch-off duration to switch-on duration, ratios of electrical resistance and heat storage capacity of said bimetal component and said support being measured with said support comprising a large-area heat radiator, so that a stop time determined on initial switch-on of the motor and a first heat-overload switch-off with continuing overload and constant current sets an increasingly shorter switch-on duration for subsequent switching cycles and an increasing ratio of switch-off duration to switch-on duration; support being in form of a flat heat radiator substantially planar parallel to and overlapping to an extent at least one of two surfaces of said bimetal component while remaining slightly off said bimetal component the ratio of the heat-storage capacities of said support to the storage capacities of said bimetal component are at least 1.5:1 to 3.5:1, the ratio of said electrical impedance of said support to the electrical impedance of said bimetal component being at least 4:1 to 8:1.

2. A device as defined in claim 1, wherein the sequence of switching cycles following the maintenance time attains a settled final heat-up state with no overshooting on the part of brush temperature and winding temperature when said motor continues to be overloaded.

3. A device as defined in claim 1, wherein the switch-on duration in said settled state is at least 0.7 seconds and the switch-off duration time is less than 15 seconds.

4. A device as defined in claim 1, wherein said bimetal component comprises a flat snap-in ring component with an inward-projecting root for securing to a fastening end bent out of a plane of said support; a stationary switch contact mounted on a connection prong; said snap-in ring having a tongue projecting out of said switch contact; another contact moved by a snapping action of said bimetal component being mounted on said tongue.

5. A device as defined in claim 1, wherein said support has a web extending over a root and adjacent areas of said bimetal component; two parallel bracing legs at the ends of said support, one leg being shorter than the other leg and opening into an adjacent bent-out fastening end projecting toward the other end of the leg,said other leg being longer and merging into a connection prong.

6. A device as defined in claim 1, including connection prongs accommodated in a base; a housing mounted on said base and accommodating said bimetal component and said support.

7. A device for protecting a fractional-horsepower motor from overheating when accommodating a high heat load, comprising: a make-or-break switch; a bimetal component for opening said switch, suddenly once a specific temperature has been attained; a support for mounting said bimetal component and having at least one part; said switch, said bimetal component, and said support being electrically connected in series; said bimetal component having an electrical impedance and a heat capacity that have a specific ratio to the electrical impedance and heat capacity of said support, said bimetal component and said support being in extensive surface-to-surface contact; said support being flat and radiating heat toward said bimetal component; said ratio being dimensioned so that switching cycles following a maintenance time determined by when the motor is first turned on and when said motor is first turned off due to overheating, provide an increasingly shorter switching-on duration as an overload continues at constant current and have an increasing ratio of switch-off duration to switch-on duration, ratios of electrical resistance and heat storage capacity of said bimetal component and said support being measured with said support comprising a large-area heat radiator, so that a stop time determined on initial switch-on of the motor and a first heat-overload switch-off with continuing overload and constant current sets an increasingly shorter switch-on duration for subsequent switching cycles and an increasing ratio of switch-off duration to switch-on duration; support having zones defined by shaping of specific areas to determine electrical impedance and heat conductivity of said support.

8. A device as defined in claim 7, wherein said zones are demarcated by at least one cutout.

9. A device as defined in claim 8, wherein said cutout is in a web on said support.

* * * * *